US010343031B1

(12) United States Patent
Day et al.

(10) Patent No.: US 10,343,031 B1
(45) Date of Patent: Jul. 9, 2019

(54) GOLF CLUB HEAD WITH OPENWORK RIB

(71) Applicant: Cobra Golf Incorporated, Carlsbad, CA (US)

(72) Inventors: Cameron J. Day, Vista, CA (US); D. Clayton Evans, San Marcos, CA (US); Steven M. Mitzel, San Marcos, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 15/786,723

(22) Filed: Oct. 18, 2017

(51) Int. Cl.
*A63B 53/04* (2015.01)

(52) U.S. Cl.
CPC .... *A63B 53/0466* (2013.01); *A63B 2053/045* (2013.01); *A63B 2053/0437* (2013.01); *A63B 2053/0491* (2013.01)

(58) Field of Classification Search
CPC ..... A63B 53/0466; A63B 2053/0437; A63B 2053/0491; A63B 2053/045; A63B 2053/0454
USPC ..... 473/324–350, 287–292, 244–248
See application file for complete search history.

(56) References Cited

U.S. PATENT DOCUMENTS 2,797,201 A 6/1957 Veatch et al.
2,880,002 A 3/1959 Wetty
3,455,558 A 7/1969 Onions
3,591,183 A 7/1971 Ford
3,695,618 A * 10/1972 Woolley ..... A63B 53/04 273/DIG. 1
3,698,239 A 10/1972 Everett, III
3,716,347 A 2/1973 Bergstrom et al.
3,814,437 A 6/1974 Winquist
3,941,390 A 3/1976 Hussey
3,961,909 A 6/1976 Shapiro
4,162,794 A 7/1979 Thompson
4,204,684 A 5/1980 Molitor
4,261,566 A 4/1981 MacDougall
4,331,477 A 5/1982 Kubo et al.
4,710,223 A 12/1987 Matejczyk
4,784,690 A 11/1988 Mullendore
4,851,042 A 7/1989 Bose et al.
4,863,538 A 9/1989 Deckard
4,877,249 A 10/1989 Thompson
4,930,781 A * 6/1990 Allen ..... A63B 53/04 164/34
4,938,816 A 7/1990 Beaman et al.
4,992,236 A 2/1991 Shira
5,062,638 A 11/1991 Shira
5,154,425 A 10/1992 Niskanen et al.
5,222,542 A 6/1993 Burke
5,260,009 A 11/1993 Penn
(Continued)

*Primary Examiner* — Sebastiano Passaniti
(74) *Attorney, Agent, or Firm* — Brown Rudnick LLP; Mark S. Leonardo

(57) ABSTRACT

The invention provides a golf club head with an openwork (e.g., lattice-like or trellis-like) internal structural element that provides strength and stiffening at key points of the club head and/or attenuates sound while adding little to the overall mass due to the defined or irregular patterns of holes, piercings, gaps, or apertures through surfaces of the material. A golf club head may be given an openwork internal rib that reinforces regions of high strain, thereby minimizing material fatigue and preventing early breakage of the club head.

5 Claims, 9 Drawing Sheets

(56) References Cited

U.S. PATENT DOCUMENTS 5,295,689 A * 3/1994 Lundberg ..... A63B 53/04 473/346
5,324,031 A 6/1994 Green
5,351,952 A 10/1994 Hackman
5,441,256 A 8/1995 Hackman
5,441,695 A 8/1995 Gladden
5,469,627 A 11/1995 Denny et al.
5,499,814 A * 3/1996 Lu ..... A63B 53/04 473/329
5,591,091 A 1/1997 Hackman
5,665,014 A 9/1997 Sanford et al.
5,669,825 A 9/1997 Shira
5,718,641 A * 2/1998 Lin ..... A63B 53/04 473/224
5,766,091 A 6/1998 Humphrey et al.
5,800,632 A 9/1998 Arao et al.
5,839,975 A * 11/1998 Lundberg ..... A63B 53/04 473/346
5,911,636 A 6/1999 Schmoll
5,938,543 A 8/1999 McGeeney et al.
5,985,208 A 11/1999 Zedalis et al.
5,997,415 A * 12/1999 Wood ..... A63B 53/04 473/346
6,089,070 A 7/2000 Hancock et al.
6,099,414 A 8/2000 Kusano et al.
6,117,204 A 9/2000 Saito et al.
6,122,564 A 9/2000 Koch et al.
6,149,534 A 11/2000 Peters et al.
6,261,329 B1 7/2001 Ogata et al.
6,322,746 B1 11/2001 LaSalle et al.
6,328,660 B1 12/2001 Bunn, III
6,364,788 B1 4/2002 Helmstetter et al.
6,410,160 B1 6/2002 Landin et al.
6,440,010 B1 8/2002 Deshmukh
6,478,842 B1 11/2002 Gressel et al.
6,508,978 B1 1/2003 Deshmukh
6,692,378 B2 2/2004 Shmoldas et al.
6,719,648 B1 4/2004 Smith
6,723,278 B1 4/2004 Lu et al.
6,723,279 B1 4/2004 Withers et al.
6,737,017 B2 5/2004 Woodfield et al.
6,878,074 B2 4/2005 Byrne et al.
6,884,486 B2 4/2005 Estrin et al.
6,956,792 B1 10/2005 Osborn et al.
6,966,843 B2 11/2005 Rankin et al.
7,041,014 B2 5/2006 Wright et al.
7,108,613 B1 9/2006 Gordon et al.
7,108,614 B2 * 9/2006 Lo ..... A63B 53/0466 473/345
7,153,215 B2 12/2006 Peterson et al.
7,156,974 B2 1/2007 Strezov et al.
7,172,519 B2 2/2007 Byrne et al.
7,223,179 B2 5/2007 Tsunoda
7,229,362 B2 6/2007 Tavares
7,247,103 B2 * 7/2007 Beach ..... A63B 53/0466 473/324
7,247,104 B2 * 7/2007 Poynor ..... A63B 53/0466 473/329
7,258,624 B2 * 8/2007 Kobayashi ..... A63B 53/04 473/324
7,273,427 B2 9/2007 Inoue et al.
7,409,353 B1 8/2008 Uslontsev et al.
7,455,599 B2 11/2008 Jones
7,481,720 B2 1/2009 Tavares
7,628,713 B2 12/2009 Tavares
7,632,193 B2 * 12/2009 Thielen ..... A63B 53/0466 473/334
7,651,403 B2 1/2010 Yamamoto et al.
7,749,104 B2 * 7/2010 Brekke ..... A63B 53/0466 473/345
7,758,453 B2 * 7/2010 Horacek ..... A63B 53/0466 473/345
7,765,022 B2 7/2010 Mazumder et al.
7,775,906 B2 8/2010 Kusumoto
7,785,218 B2 8/2010 Burnett et al.
7,887,433 B2 2/2011 Hoffman et al.
7,887,440 B2 2/2011 Wright et al.
7,993,216 B2 8/2011 Lee
8,007,373 B2 * 8/2011 Soracco ..... A63B 53/04 473/349
8,012,045 B2 9/2011 Turner
8,075,421 B2 12/2011 Hirano
8,197,358 B1 * 6/2012 Watson ..... A63B 53/0466 473/334
8,323,122 B2 12/2012 Soracco et al.
8,360,903 B2 1/2013 Carlyle et al.
8,430,763 B2 * 4/2013 Beach ..... A63B 53/06 473/307
8,475,292 B2 * 7/2013 Rahrig ..... A63B 53/0466 473/324
8,591,352 B2 * 11/2013 Hirano ..... A63B 53/0466 473/336
8,992,339 B2 * 3/2015 Matsunaga ..... A63B 53/04 473/335
9,101,970 B2 8/2015 Shimai
9,138,619 B2 * 9/2015 Takechi ..... A63B 53/0466
9,199,139 B2 12/2015 Kronenberg et al.
9,199,141 B2 12/2015 Cardani et al.
9,199,144 B2 12/2015 Mendoza et al.
9,330,406 B2 5/2016 Soracco et al.
9,346,219 B2 5/2016 Taylor et al.
9,364,726 B2 6/2016 Sugimae et al.
9,452,323 B2 * 9/2016 Kronenberg ..... A63B 53/0466
9,498,684 B2 * 11/2016 Motokawa ..... A63B 53/0466
9,498,686 B2 11/2016 Breier et al.
9,579,718 B2 2/2017 Hofmann
9,594,368 B2 3/2017 Kronenberg et al.
9,855,475 B2 * 1/2018 Motokawa ..... A63B 53/0466
2002/0059049 A1 5/2002 Bradbury et al.
2002/0091014 A1 7/2002 Aldrich
2002/0169035 A1 * 11/2002 Liu ..... A63B 53/0466 473/346
2003/0013542 A1 1/2003 Burnett et al.
2003/0060306 A1 3/2003 Aldrich
2003/0203764 A1 10/2003 Dabbs et al.
2003/0221347 A1 12/2003 Peterson et al.
2004/0082404 A1 4/2004 Willett et al.
2004/0204257 A1 10/2004 Boscha et al.
2004/0235582 A1 11/2004 Solheim et al.
2005/0143189 A1 * 6/2005 Lai ..... A63B 53/0466 473/335
2006/0052181 A1 3/2006 Serrano et al.
2006/0058112 A1 * 3/2006 Haralason ..... A63B 53/0466 473/334
2006/0105856 A1 * 5/2006 Lo ..... A63B 53/0466 473/334
2006/0129462 A1 6/2006 Pankl et al.
2008/0026891 A1 1/2008 Oseto
2008/0235934 A1 10/2008 Burnett et al.
2010/0298065 A1 11/2010 Soracco et al.
2011/0082771 A1 4/2011 Pritikin et al.
2011/0151996 A1 * 6/2011 Dewhurst ..... A63B 53/0466 473/329
2011/0306441 A1 12/2011 Tsukada et al.
2011/0312437 A1 * 12/2011 Sargent ..... A63B 53/02 473/335
2012/0302379 A1 11/2012 Margoles et al.
2013/0109503 A1 * 5/2013 Matsunaga ..... A63B 53/00 473/346
2013/0324301 A1 12/2013 Boyd et al.
2013/0324308 A1 * 12/2013 Boyd ..... A63B 53/0466 473/346
2014/0221125 A1 * 8/2014 Day ..... A63B 53/04 473/343
2014/0256463 A1 * 9/2014 Knight ..... A63B 53/0466 473/332
2015/0151175 A1 * 6/2015 Lytle ..... A63B 53/047 473/291
2015/0306475 A1 10/2015 Curtis et al.
2016/0151861 A1 6/2016 Soracco et al.
2016/0289468 A1 10/2016 Turner

(56) References Cited

U.S. PATENT DOCUMENTS

| | | | |
|---|---|---|---|
| 2017/0036077 | A1 | 2/2017 | Warren |
| 2017/0173414 | A1 | 6/2017 | Motokawa |
| 2017/0185070 | A1 | 6/2017 | Kronenberg et al. |

* cited by examiner

GOLF CLUB HEAD WITH OPENWORK RIB

TECHNICAL FIELD

The disclosure relates to golf clubs.

BACKGROUND

People are drawn to golf for a number of reasons. For example, many people innately enjoy challenges of personal skill. But unlike more intensive sports like weightlifting or basketball, golf is more inclusive. People of all ages can play, and golf does not require any particular trait such as extreme muscle mass or height. Every golfer has some chance of making a hole in one and sooner or later, most golfers do. Golf is attractive because players get to spend time outdoors, in beautiful locales. The fact that golf is one of the professional sports in which every playing field is unique adds to its appeal. Players can seek out new and diverse environments in which to play. People like golf because it is a prestigious sport. Anyone can play. Every player at least occasionally makes a great shot. But winning a tournament shows that a golfer has excelled at his or her game and mastered the sport. Perhaps the overriding reason that people are drawn to golf is the opportunity to demonstrate mastery, the chance to excel.

To excel at golf, one must consistently hit well. One must be able to make long drives towards the green, for example. From the tee box, a golfer would like to get the ball way down the fairway, close to or even onto the green without going out into the rough. To achieve such performance, the golfer needs golf clubs such as a driver that hits the ball a great distance and is forgiving with off-center hits. Unfortunately, designing a golf club involves engineering tradeoffs between distance and forgiveness.

One approach to making a golf club head forgiving to off-center hits involves increasing the club head's moment of inertia about a vertical axis. This is done by placing as much mass of the club head as possible far out towards the outer edges of the heel, toe, and aft areas of the club head. This type of mass distribution means that portions of the crown and sole and other key structural areas of the club head must be light weight, i.e., made with a minimal amount of mass. Such a construction may sacrifice durability of the club head. A good golfer may swing the driver such that the club head hits the ball while travelling at 100 miles per hour. Repeated hits with this much force may fatigue or crack fragile materials. As such, key portions of the crown and sole must be built durably, with thick and heavy materials, lest the golf club head crack and fail early in its life.

SUMMARY

The invention provides a golf club head with an openwork internal structural element that provides strength and stiffening at key points of the club head and/or attenuates sound while adding little to the overall mass. Openwork from architecture and design generally refers to materials with lattice-like or trellis-like structures, or pieces that have defined or irregular patterns of holes, piercings, gaps, or apertures through surfaces of the material. A golf club head may be given an openwork internal rib that reinforces regions of high strain, thereby minimizing material fatigue and preventing early breakage of the club head. The internal rib or support member may brace an inside surface of a ball-striking face, thereby optimizing a rebound effect of the club head without sacrificing structural integrity. Because the internal rib or buttress or other such element has an openwork structure, it adds little mass to the club head in proportion to how much the element contributes to strength and durability of the club head. Because the club head can be significantly reinforced and structurally improved without significant increases in mass, discretionary mass is "freed up", allowing the club head designer to locate mass of the club head distal from a vertical axis, thereby increasing moment of inertia about the vertical axis. Because the club head has a high moment of inertia, it is forgiving to off-center hits. Because the club head is structurally reinforced, it can strike balls with great speed without compromise to its material integrity, and thus can make very long shots. Because club head is forgiving and achieves great distance, it will provide playing satisfaction to a great variety of golfers, golfers with diverse playing strengths and skills. For those reasons, the golf club will aid players in making long shots that go far towards the green without ending up in the rough. Thus the golf club will give many different players opportunities to experience and demonstrate their mastery and excellence at the sport.

An important benefit of the invention is the ability to attenuate sound in a golf club head by the inclusion of a support member with an openwork structure. Some golfers may find that their game suffers if they hear a distracting or unpleasant sound when a golf club strikes a golf ball. Methods such as finite element analysis may be used to determine a location for a support member that modulates such a distracting or unpleasant sound into a striking sound that is less invasive and detrimental to play. By virtue of an openwork structure, the sound-attenuating support member does not add significant mass to a club head, allowing the club head to have an optimal mass distribution and an optimal sound. For such embodiments, a support member may be disposed at any suitable location within the club head. For example, the support member may extend from crown to sole, or may be disposed in any orientation inside the head.

Another benefit of the invention is the ability to tune physical dynamics of a ball-striking face of a club head. Thus an openwork structure may be provided as, for example, a rib making substantial contact with a back surface of the face. A rib structure on the face may be used to optimize the rebound effect without sacrificing structural integrity since the face must withstand the ball impact forces. A support member or openwork rib may be disposed wholly on the face, or may extend over both a back surface of the face and an inside surface of a crown, sole, or both, or may form a bridge between a back surface of the face and an inside surface of a crown, sole, or both.

Embodiments of the invention include a rational methodology for making such a club in which each step of component fabrication and assembly is controlled according to a systematic analysis. A hypothetical club head is modeled, and finite element analysis identifies optimal regions of the model for a structural element, such as a reinforcing rib, truss, or buttress. An overall suitable shape for such a rib is determined, and regions for the exclusion of material can be identified in the shape via a systematic and replicable process such as determining a Voronoi or a honeycomb pattern through the shape. The shape with its material exclusion regions is used in manufacturing the structural element. For example, a crown and sole of the club head can be fabricated (e.g., by casting or molding), and the structural element can be 3D printed from a set of computer instructions embodying the shape.

A 3D printer can implement fashioning a complex shape with an arbitrary pattern of excluded material, i.e., an openwork structural element. The printed structural element can be fastened to the crown, sole, or other components before those are joined together into a finished club head. For example, where the openwork structure is 3D printed from a metal such as titanium, by a process such as direct laser metal sintering, the structural element may be welded (e.g., tack-welded) to an inside surface of the sole before the sole and crown are joined (e.g., by an adhesive).

In certain aspects, the invention provides a golf club head. The golf club head includes a ball-striking face with a crown and a sole extending back from the ball-striking face and cooperating to define an enclosed hollow body. A hosel extends upwards from a heel side of the hollow body when the club head is at address. A support member comprising an openwork structure is disposed within the hollow body. Due to the discretionary mass associated with the use of an openwork structure, the club head may include other features relating to mass, such as extreme perimeter weighting, or user-adjustable mass-adjustment mechanisms. Thus, in some embodiments, the club head further includes an adjustment mechanism for adjusting a feature of the club head. The adjustment mechanism may include one or more attachment points for removable features. For example, the club head may include at least one removable weight removably attached to at least one of the one or more attachment points such that the adjustment-mechanism allows for adjustment of a mass or mass distribution of the club head.

In some embodiments, the support member defines a rib, fastened at least partially to an interior surface of the sole. In some embodiments, the support member defines an extended ridge with at least a first side and a second side and the openwork structure includes a plurality of apertures through the first side and the second side.

In preferred embodiments, the support member is made by an additive or subtractive manufacturing process, such as by 3D printing or by computer numeric controlled (CNC) machining. In a most preferred embodiment, the support member is 3D printed and comprises a metal. The support member may be attached to an inside surface of the hollow body (e.g., by tack-welding). A support member has an openwork structure that may be a systematically determined structure. For example, the openwork structure may define a Voronoi pattern or a honeycomb structure.

In some preferred embodiments, the club head is a driver-style club head in which the crown includes metal, composite, plastic, thermoplastic, or carbon fiber, and in which the sole includes a first metal, and further in which the support member is fastened to an inside surface of the sole. The openwork structure of the support member is a 3D-printed lattice. The support member may define a rib extending along an inside surface of the sole such that the rib has the lattice structure as the openwork structure. The support member may be described as an extended ridge with at least a first side and a second side and the openwork structure includes a plurality of apertures through the first side and the second side. In some embodiments, the support member defines an extended, substantially planar rib and the openwork structure includes a plurality of apertures through the rib. In certain embodiments, the support member defines a buttress extending between an inside surface of the hosel and an inside surface of the sole. Whichever form, the openwork structure preferably defines a mesh-like or lattice-like structure, which may include, e.g., a Voronoi pattern or a honeycomb structure.

Aspects of the invention provide a method of making a golf club head. The method includes creating a digital model of club head (the modelled club head includes at least a crown and a sole cooperating to define an enclosed hollow body with a hosel extending upwards from a heel side of the hollow body when the club head is at address; the model is stored in a non-transitory memory), analyzing the model to determine an optimal location for a support member, and determining an openwork structure for the support member. The method further includes fabricating the crown and the sole, making the support member, attaching the support member to an inside surface of the sole, and joining the crown with the sole to form the enclosed hollow body. Fabricating the crown or the sole may be done by casting or molding. The support member is preferably made by an additive or subtractive manufacturing process such as 3D printing with a metal. The support member may be attached to an inside surface of the club head by use of an adhesive or welding. Optionally, a ball-striking face is welded to the enclosed hollow body to form a playable golf club head.

The model may be created using a computer (with a processor coupled to non-transitory memory) and stored as one or more files in the non-transitory memory (for 3D printing). An optimal location within the club head for the support member may be determined by performing a finite element analysis of the model to identify at least one location of the model where a golf club head built according to the model will exhibit strain in response to stress associated with striking a golf ball. The openwork structure may be determined according to a systematic application of pre-determined rules. In some embodiments of the method determining the openwork structure includes designing an outer form for the support member using the computer and adding the openwork structure to the outer form according to a predetermined methodology. For example, the openwork structure may be determined according to a predetermined methodology such as by partitioning (using computer modeling software) a planar surface on a computer model of the support member into regions to define a Voronoi diagram.

In preferred embodiments, the method is used to create a driver-style club head. The sole may be made with metal and the crown made with a thermoplastic, composite, or polymer. The crown may be joined with the sole via the application of adhesive. In preferred embodiments, making the support member is done by additive manufacturing of a metal. Preferably, the method proceeds by fabricating the sole, then attaching the support member to an inside surface of the sole by welding; and then joining the crown with the sole to form the enclosed hollow body.

DETAILED DESCRIPTION

Figure 1:
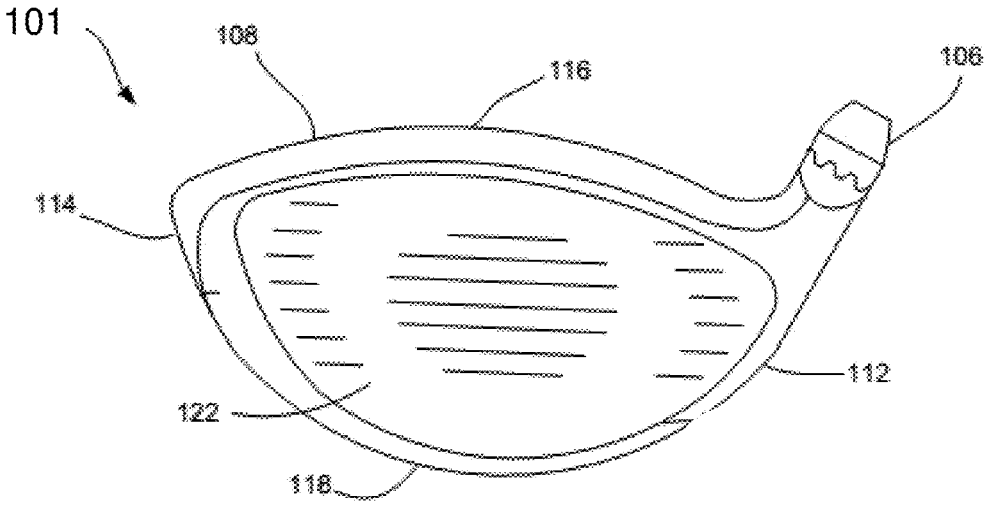
FIG. 1 shows a club head according to the disclosure.

The invention relates to a golf club head, such as a metal wood head, with a support member within the head to reinforce what would otherwise be structural weak points and/or to improve club head function. The invention also relates to methods of making such a club head by creating a model of the club head and analyzing the model to determine an optimal location for the support member. Analyzing the model to determine the optimal location for the support member may be done by performing a finite element analysis (FEA) of the model to identify key locations, such as a region of the model at which a golf club head built according to the model would exhibit strain (e.g., deformation, fatigue, or breakage) in response to stress associated with striking a golf ball. To optimize mass distribution and playing characteristics of the club head, the support member is given an openwork structure.

Methods of the invention may use the FEA to determine locations for rib optimization, and may use openwork structure to optimize a shape of the rib, its internal structure, material usage, or mass distribution. Preferred embodiments of methods of the invention employ FEA to place a rib or internal support member in an optimized location and also use an algorithmic method to optimize the shape, material usage, or structure of the rib to achieve an optimized rib that minimizes the material needed to provide the most optimized structure. Modeling material and structure of the rib (e.g., by reducing a digital model of a bulk mass of material to an openwork structure by computationally adding exclusionary zones according to a systematic approach such as drawing a Voronoi pattern on the modelled structural element and then extending that pattern through the model to create exclusionary zones) may mean that material is generally removed while still providing the needed stiffness. The resulting support member has an openwork structure. Embodiments of the invention include techniques for making the support member with its openwork structure. Suitable techniques include additive manufacturing of metal components such as by direct laser metal sintering or 3D printing. Components may be made by reductive techniques such as computer-numeric controlled (CNC) milling. Components may also be made by rapid prototyping out of metal that is then welded to a club head or rapid prototyping out of polymer or wax that is then investment cast into metal.

The described methods may be used to produce a support member with an openwork structure that is assembled into a golf club head (e.g., spot-welded into the club head). The support member may provide a rib or truss having a lattice-like structure, e.g., a rib with a resemblance to organic bone marrow, radiolarian protozoan, or more linear man-made lattice type structures.

Openwork or open-work is a term in architecture, art, design and related fields for techniques and materials characterized by holes, piercings, or gaps through a solid material such as metal, wood, stone, pottery, cloth, leather, or ivory. Openwork structures may make use of additive techniques that build up the workpiece or techniques that take a plain material and make cuts or holes in it. See U.S. Pat. No. 6,956,792, incorporated by reference.

FIG. 1 shows a club head 101. The club head 101 includes a crown 116 extending back from a ball-striking face 122 and cooperating with a sole 118 to define an enclosed hollow body 108. The body includes a heel side 112 and a toe side 114. A hosel 106 extends upward from the heel side 112 of the body 108 when the club head 101 is at address.

Figure 2:
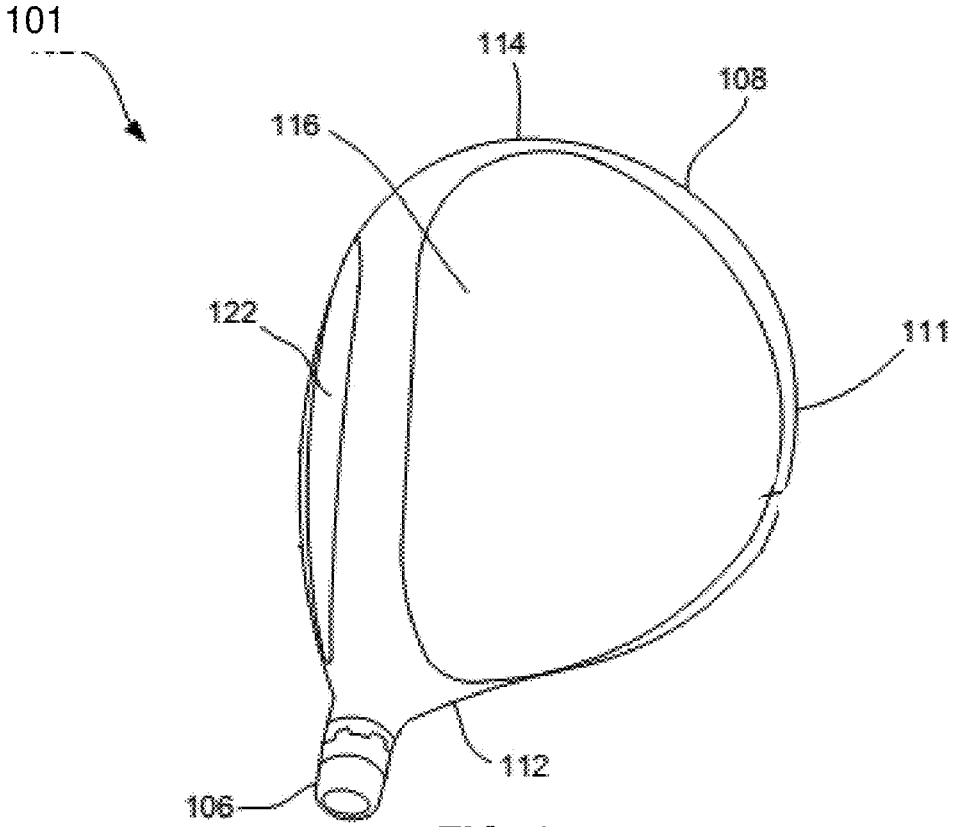
FIG. 2 is a top-down view of the club head.

FIG. 2 is a top-down view of the club head 101, showing the crown 116 extending back from the ball-striking face 122. The crown 116 meets the sole at an aft portion 111 of the club head 101. The club head 101 may be any suitable type of hollow club head and is preferably a hollow, metal wood club head. In the depicted embodiment, the club head 101 is a driver-style club head.

The club head 101 may be made of any suitable material or materials including materials such as metals, plastics, metal alloys, composite materials, others, or combinations thereof. For example, the crown 116 may include metal, composite, plastic, thermoplastic, or carbon fiber. In certain embodiments, the sole 118 will include a metal (which may be referred to as a first metal, not to imply an order but to distinguish from other metals used in the club head 101, whether those metals are the same or different). For example, the sole 118 as well as portions of the body 108 (e.g., the heel portion 112, the toe portion 114, and the aft portion 111) may be made of a first metal or metal alloy such as pure or alloyed steel, titanium, aluminum, others, or combinations thereof. In certain embodiments, the sole 118, the heel portion 112, the toe portion 114, and the aft portion 111 or provided as one titanium casting. The crown 116 may be a lightweight material such as a composite, carbon fiber, or pre-peg that is bonded to the titanium casting by, for example, an adhesive around a perimeter of the crown.

As mentioned, the sole 118, the heel portion 112, the toe portion 114, the aft portion 111, and the crown 116 cooperate to define an enclosed, hollow body 108 of the club head 101. The club head 101 includes, within the enclosed hollow body 108, an openwork internal structural element that provides strength and stiffening at key points of the club head while adding little to the overall mass.

Figure 3:
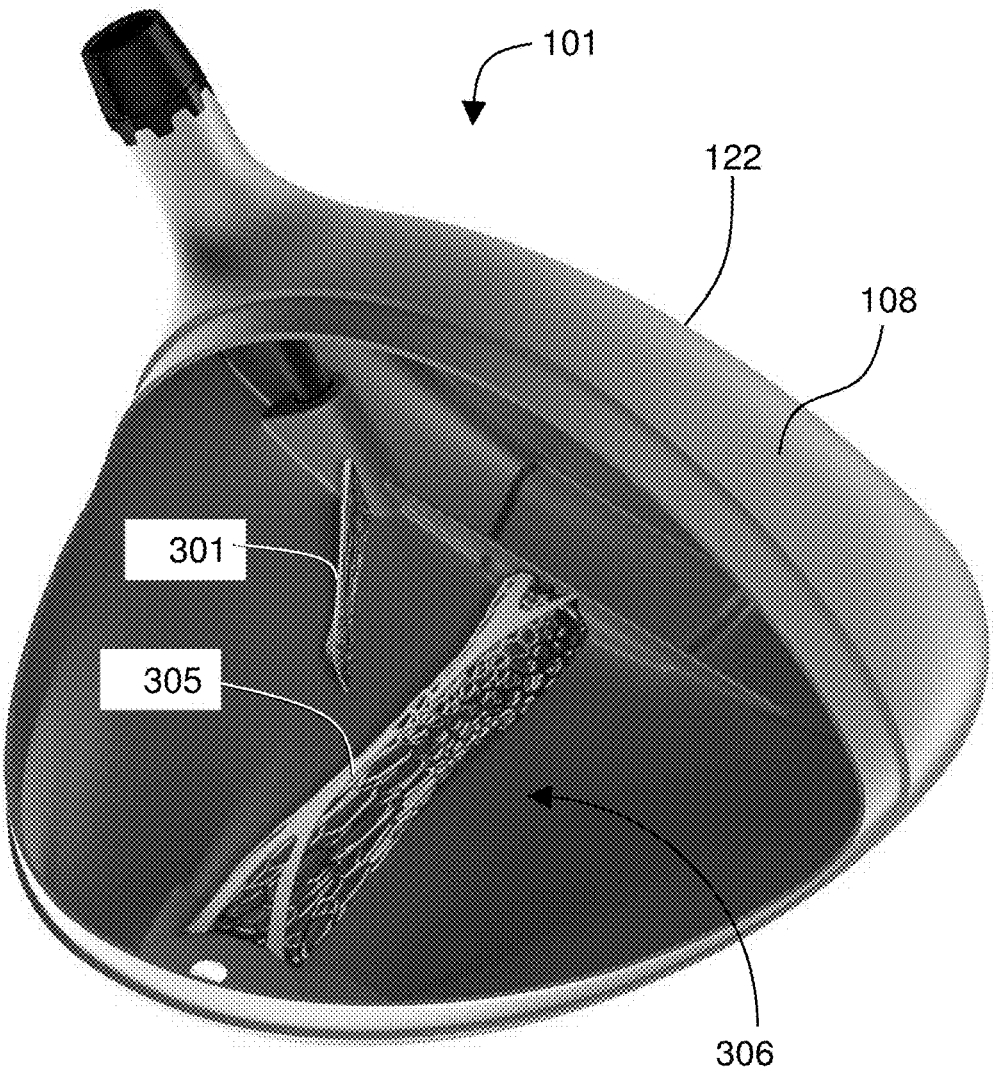
FIG. 3 is a cutaway view of the club head.

FIG. 3 is a cutaway view of the club head 101. The club head 101 includes a first, buttress-style support member 301 with an openwork structure 306 disposed within the hollow body. In the depicted embodiment, the club head 101 also includes a ridge-style support member 305 within the body 108. The buttress-style support member 301 and the ridge-style support member 305 each have an openwork structure 306.

A support member of the invention may have any suitable shape or configuration. For example, rib and ridge generally refer to shapes and any other suitable shape may be used, including apparently irregular shape. Configuration generally describes the shape and positioning of the support member within the club head.

Figure 4:
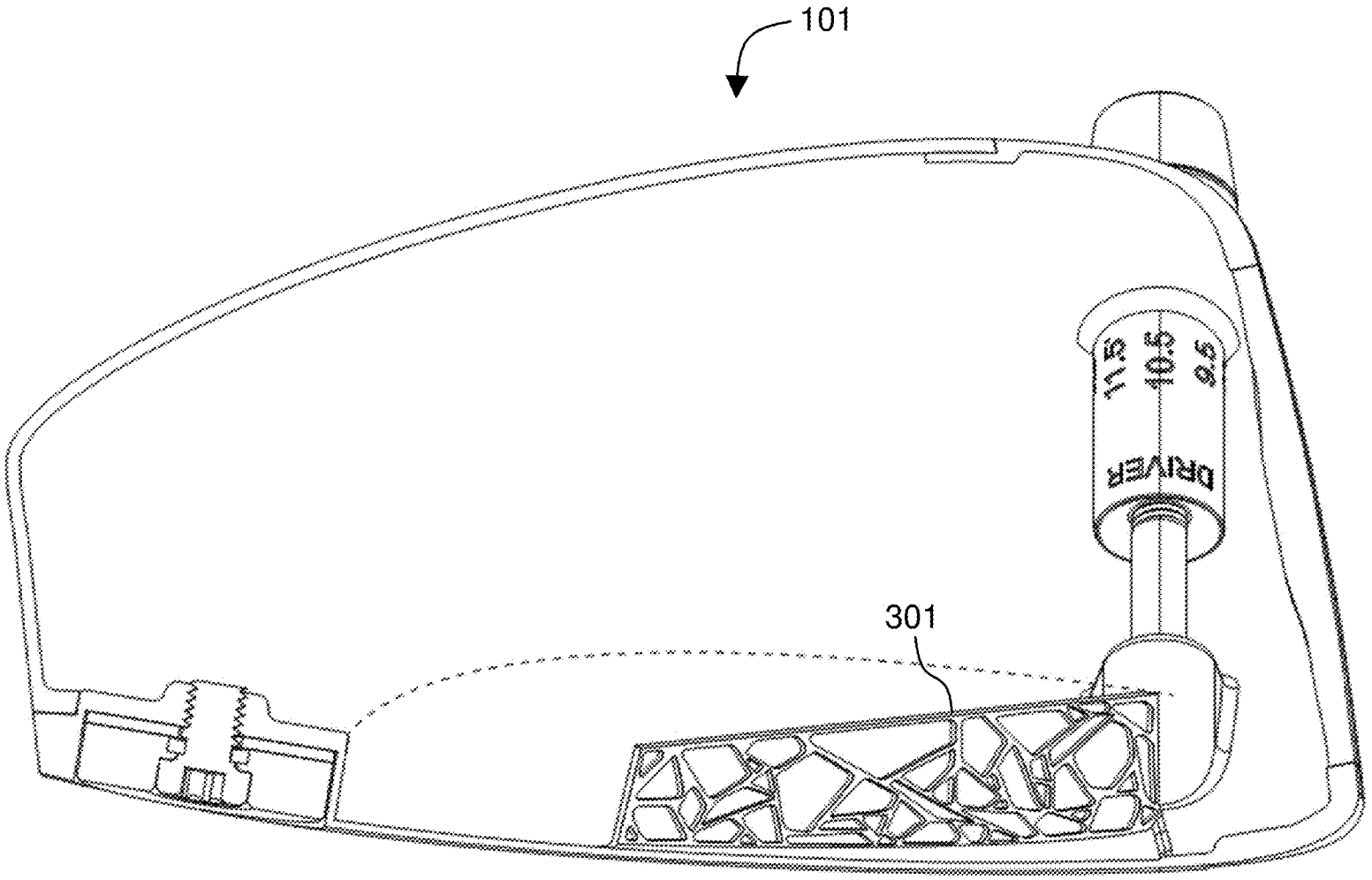
FIG. 4 is a cutaway side view of the club head.

FIG. 4 is a cutaway side view of the club head 101 showing the buttress-style support member 301 and also including a dashed to line to show a location of the ridge-style support member 305 (which has been omitted in all but a dashed line for clarity). It can be seen that the buttress-style support member 301 defines a rib, fastened at least partially to an interior surface of the sole 118. In the depicted embodiments, the buttress-style support member 301 is also fastened at least partially to an interior portion of the hosel 106 or a shaft-connection mechanism.

Figure 5:
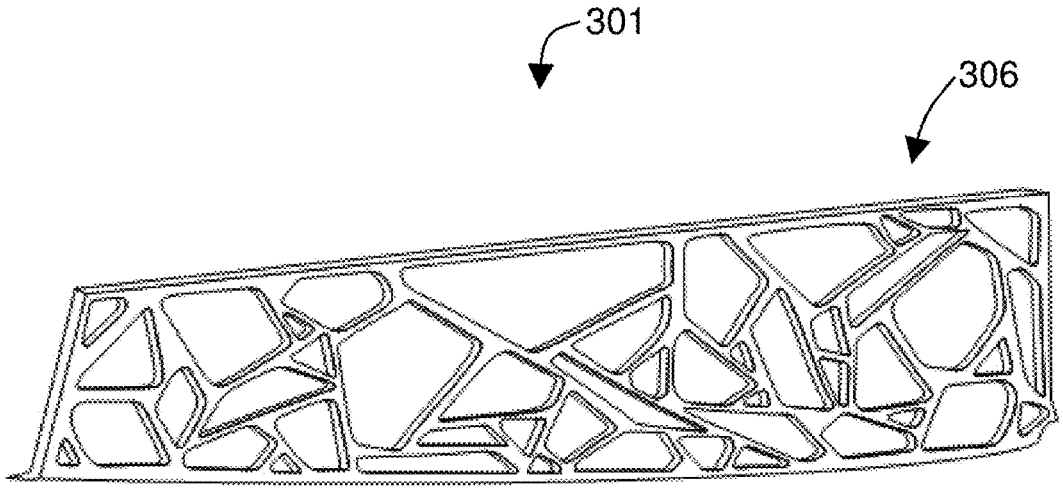
FIG. 5 shows the buttress-style support member.

FIG. 5 shows the buttress-style support member 301 as a part for the club head, e.g., as may be made separately from fabricating the titanium casting for body 108. The buttress-style support member 301 can be described as having a rib-like shape and a buttress-like configuration.

Figure 6:
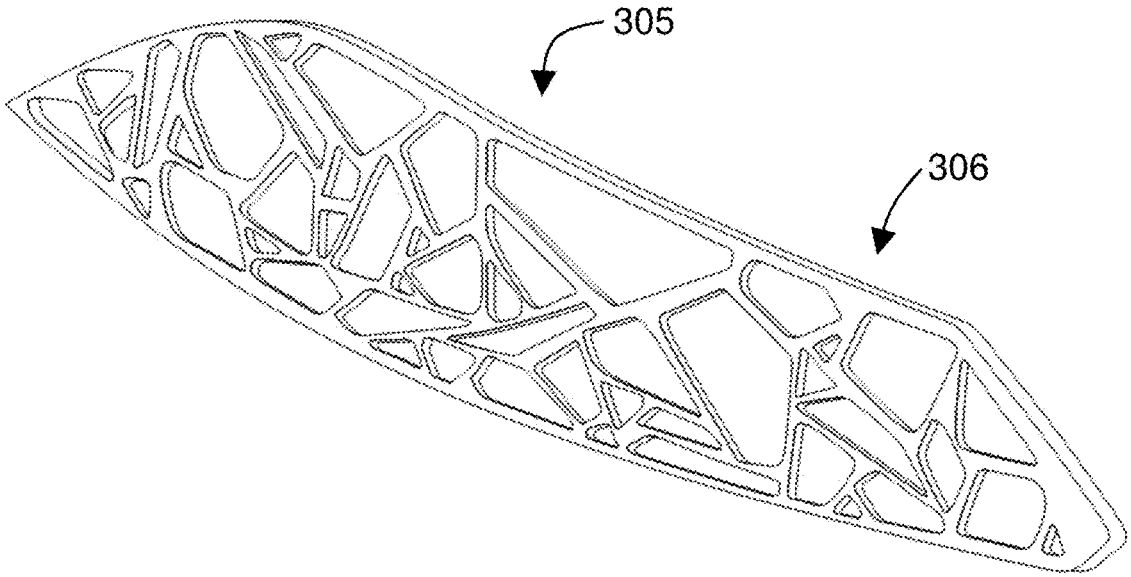
FIG. 6 shows a side view of the ridge-style support member.

FIG. 6 shows a side view of the ridge-style support member 305 outside of the club head 101 (e.g., before it is tack-welded to an inside surface of the sole 118). The ridge-style support member 305 may be described as having a ridge-like shape and its configuration may be described as being attached along an inside surface of the sole 118 extending up into an interior volume of space of the enclosed, hollow body 108. The ridge-style support member 305 may also generally be described as a rib fastened at least partially to an interior surface of the sole 118. More specifically, the ridge-style support member 305 defines an extended ridge with at least a first side and a second side and the openwork structure includes a plurality of apertures through the first side and the second side.

Each support member 301, 305 may be made independently of making other parts for the club head 101. In some embodiments, the support member 301, 305 is made by an additive or subtractive manufacturing. For example, the support member 301, 305 may be made by CNC machining (subtractive). In certain embodiments, the support member 301, 305 is made by additive manufacturing, for example by 3D printing. One methods for making a 3D printed metal piece is direct metal laser sintering (DMLS). A piece may be 3D printed via DMLS according to methods set forth in U.S. Pat. Nos. 8,323,122, 8,007,373, or 9,330,406, each incorporated by reference. A piece may be made using techniques described in U.S. Pat. No. 6,723,278 or 6,122,564, both incorporated by reference. Such techniques may be used so that the support member 301, 301 is 3D printed and comprises a metal. Preferably, the support member 301, 305 is tack-welded to an inside surface of the hollow body 108. Embodiments may include features or methods described in U.S. Pub. 2017/0173414; U.S. Pat. No. 9,364,726; or 7,887,433, each incorporated by reference.

Each support member 301, 305 includes an openwork structure 306. A feature of the disclosure is the provision of methods for creating a support member with an openwork structure 306. Where the support member is created via additive manufacturing, for example, the support member may be made with reference to a CAD model. Additive manufacturing allows for workpieces that include hypothetically impossible-to-mold topologies, such as openwork structures. Within a model of part(s) or all of a club head, a computer system may be used to determine an openwork structure according to a set of rules. For example, an openwork structure 306 may define a Voronoi pattern or a honeycomb structure. By including an openwork structure 306, a mass of the support member is significantly reduced (relative to a club head that is similar but lacks an openwork structure). Because the mass is reduced, a club head designer has additional discretionary mass to place elsewhere on the club head. For such reasons, it is particularly beneficial to include an openwork structure 306 on a club head with an adjustment mechanism, such as a mechanism for adjusting (e.g., by a golfer) a mass distribution of a club head.

Figure 7:
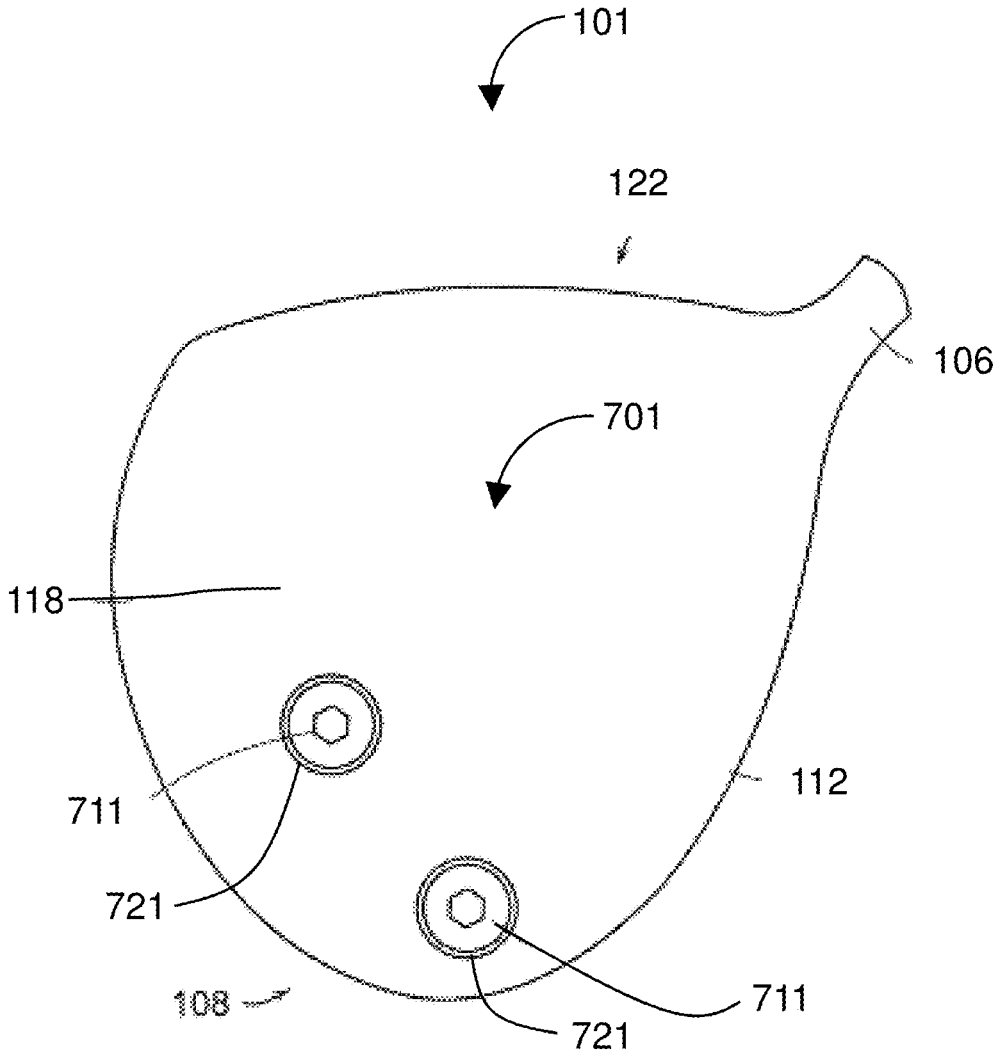
FIG. 7 shows an adjustment mechanism of the club head.

FIG. 7 shows an adjustment mechanism 701 for adjusting a feature of the club head. In the depicted embodiment, the adjustment mechanism 701 includes one or more attachment points 721 for removable features. Specifically, the adjustment mechanism 701 includes at least one removable weight 711 removably attached to at least one of the one or more attachment points 721 such that the adjustment-mechanism 701 allows for adjustment of a mass or mass distribution of the club head.

Because the club head 101 includes one or more support member with an openwork structure, mass is freed up and the club head 101 can also include an adjustment mechanism 701 with features such as re-positionable weights 711, allowing a golfer to adjust the club head mass. Due to the freed up discretionary mass, those weights 711 may have a mass higher than would otherwise be possible. Thus a golfer may opt to position a high amount of mass near an aft section of the club head, giving that golfer very long drives in which the ball bores forward. As such, the support members may have particular applicability within a driver-style club head.

Figure 8:
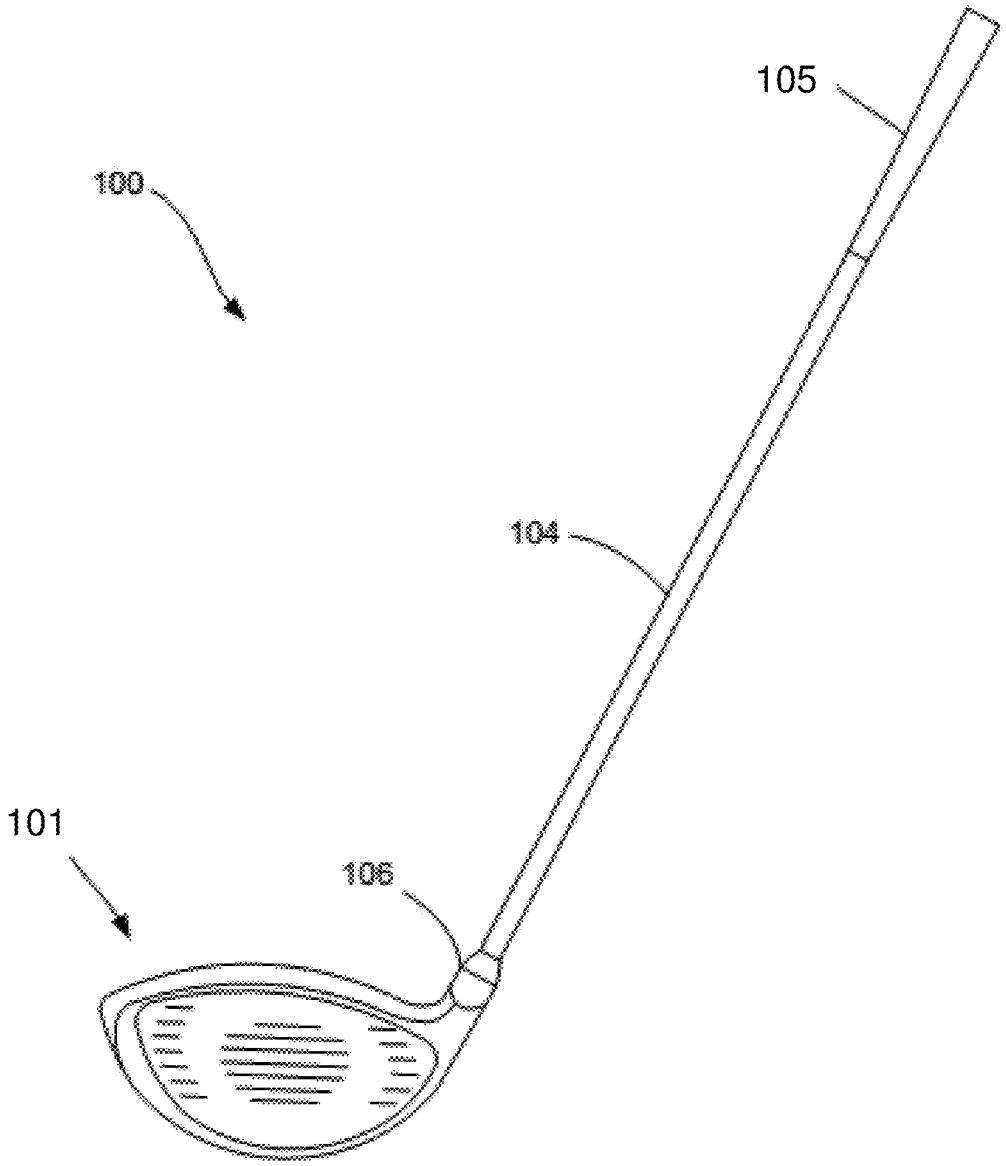
FIG. 8 shows a golf club that includes the club head.

FIG. 8 shows a golf club 100 that includes the club head 101. The golf club 100 includes a shaft 104 extending from the hosel 106, with a grip 105 at a proximal end of the shaft 104. The club head 101 includes, within the enclosed hollow body 108, one or more support member 301, 305, each of which have an openwork internal structure that provides strength and stiffening at key points of the club head while adding little to the overall mass. Embodiments of the disclosure further provide process by which such a golf club, or the club head 101, may be formed. In preferred embodiments, one or more support member 301, 305 are made using a 3-D printed method, in which finite element analysis and algorithmic design principles are used to design and make the support member in the club head. For example, in some embodiments, the support member is designed using a computer model (e.g., in CAD), the open work structure is added via an algorithmic approach such as the application of a Voronoi pattern or a honeycomb structure, and support member is 3D printed from a metal such as titanium and tack welded to the club head.

Similar methods may be applied to the fabrication of other parts of the club head, In certain embodiments, a component of a club head is designed with an openwork structure and fabricated, and added as part of a club head. Any suitable part may be created by such processes. Example parts that may be made by 3D design and 3D printing include a ball-striking face, a medallion, a hosel, or other parts of the club head. Any suitable 3D printing method is used. For example, in some embodiments, the support member includes a non-metallic or metallic material (or both), and is made via sintering.

Figure 9:
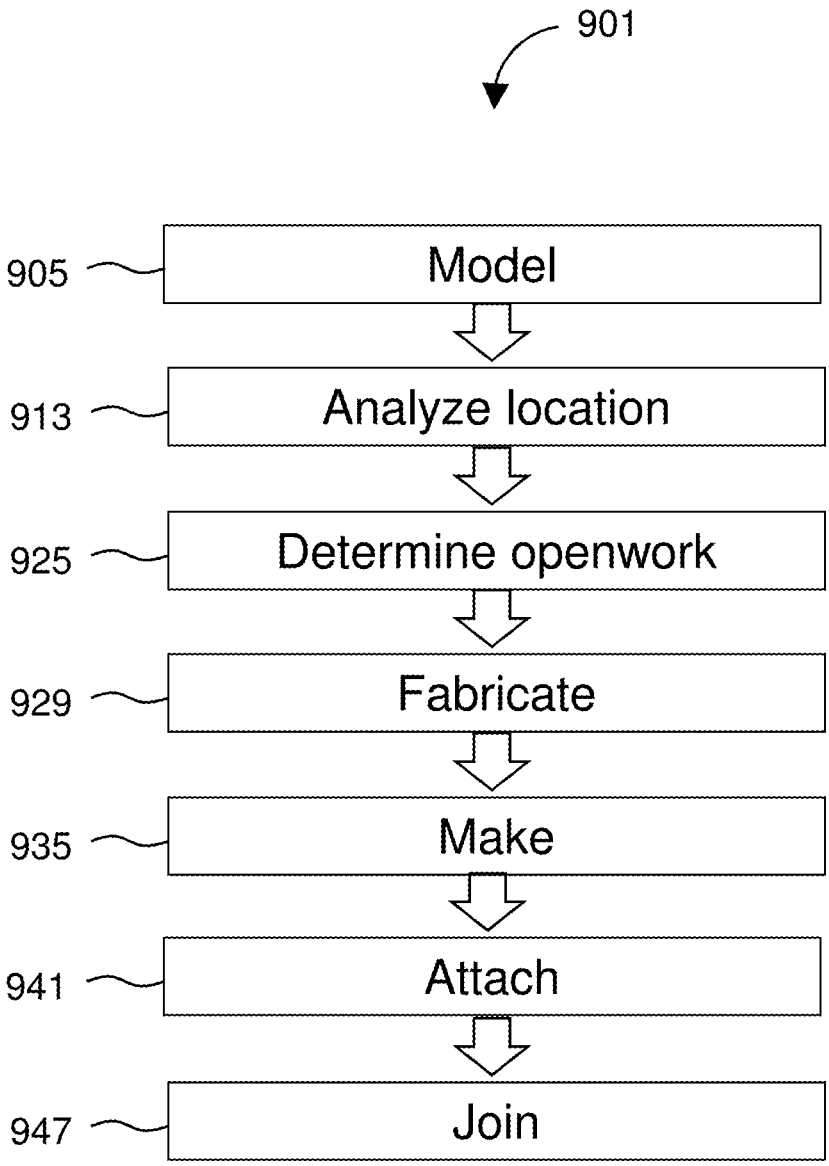
FIG. 9 diagrams a process of making a golf club head.

FIG. 9 diagrams a process 901 of making a golf club head. The process 901 includes creating a model 905 of club head that includes at least a crown and a sole cooperating to define an enclosed hollow body with a hosel extending upwards from a heel side of the hollow body when the club head is at address. The model is analyzed 913 to determine an optimal location for a support member. Within the model, an openwork structure for the support member is determined 925. The process 901 includes fabricating 929 the crown and the sole, making 935 the support member, attaching 941 the support member to an inside surface of the sole, and joining 947 the crown with the sole to form the enclosed hollow body.

Analyzing 913 the model to locate the support member may be done by any suitable means. For example, finite element analysis may be performed in modeling software using an algorithmic method to determine the best placement, shape, structure, and material for the support member. A finite element analysis of the model may be used to identify a location of the model where a golf club head built according to the model will exhibit strain in response to stress associated with striking a golf ball. Locating a support member in such a high-strain location may benefit the club head by reinforcing what may otherwise be a point of early materials fatigue or failure.

Determining 925 an openwork structure for the support member may include the use of any suitable stratagem or modeling tools. Preferred embodiments exploit that the support member will be made by additive manufacturing such as 3D printing, allowing arbitrarily complex topologies. The openwork structure may be determined using a tool such as Autodesk Meshmixer. The openwork structure may be added to the support member within such a tool by the application of a systematic set of rules, such as by making a Voronoi Pattern on a surface of the member and then 3D printing the support member to exclude material under the closed loops of the Voronoi pattern. Another tool that may be used is the Rhino Plugin 'Grasshopper'.

In preferred embodiments, the model is created 905 using a computer comprising a processor coupled to non-transitory memory, and the model is stored as one or more files in the non-transitory memory. Determining 925 the openwork structure may be done by designing an outer form for the support member using a computer comprising a processor coupled to non-transitory memory and adding the openwork structure to the outer form according to a predetermined methodology. Preferably, the openwork structure is determined 925 according to a predetermined methodology that includes partitioning, using computer modeling software, a planar surface on a computer model of the support member into regions to define a Voronoi diagram.

In some embodiments of the method fabricating 929 the crown and the sole includes casting or molding. Any suitable material may be used. For example, the sole may be made of metal such as titanium and the crown may be made from a thermoplastic, composite, or polymer.

In certain embodiments, making 935 the support member is done by an additive manufacturing, e.g., from one or more metals, such as by 3D printing. The support member is made 935 by 3D printing and attached to an inside surface of the sole via welding. Additive manufacturing according to the disclosure allows for seamlessly transitioning one material to another. Additive manufacturing thus provides for joining dissimilar materials. Internal support members such as ribs may be made according to such methods due to the level of intricate detail that can be obtained via methods such as 3D printing.

The support member 301,305 with its intricate openwork structure 306 may then be attached 941 to the club head by, for example, welding.

The crown may by joined 947 to the sole. This may be done by the application of adhesive. It may be preferable to perform the steps of process 901 by first fabricating 929 the sole 118 (e.g., by casting titanium), then attaching 941 the support member 301, 305 to an inside surface of the sole 118 by welding, and then joining 947 the crown 116 with the sole 118 to form the enclosed hollow body 108. E.g., the crown 116 may be a carbon fiber or prepeg piece that is cemented to the sole 119 around its perimeter.

Thus, the process 901 is a method of making a golf club head, the method comprising: creating a model of club head that includes at least a crown and a sole cooperating to define an enclosed hollow body with a hosel extending upwards from a heel side of the hollow body when the club head is at address; analyzing the model to determine an optimal location for a support member; determining an openwork structure for the support member; fabricating the crown and the sole; making the support member; attaching the support member to an inside surface of the sole; and joining the crown with the sole to form the enclosed hollow body.

The process provides embodiments of the method, wherein fabricating the crown and the sole include casting or molding, wherein making the support member includes 3D printing, and wherein attaching the support member to an inside surface of the sole includes welding.

The process provides embodiments of the method, wherein creating the model is performed using a computer comprising a processor coupled to non-transitory memory, and the model is stored in one or more files in the non-transitory memory.

The process provides embodiments of the method, wherein determining the openwork structure includes designing an outer form for the support member using a computer comprising a processor coupled to non-transitory memory and adding the openwork structure to the outer form according to a predetermined methodology.

The process provides embodiments of the method, wherein the openwork structure is determined according to a predetermined methodology that includes partitioning, using computer modeling software, a planar surface on a computer model of the support member into regions to define a Voronoi diagram.

The process provides embodiments of the method, wherein analyzing the model to determine the optimal location for the support member includes performing a finite element analysis of the model to identify at least one location of the model where a golf club head built according to the model will exhibit strain in response to stress associated with striking a golf ball.

The process provides embodiments of the method, further comprising welding a ball-striking face to the enclosed hollow body to form a playable golf club head.

The process provides embodiments of the method, wherein the club head is a driver. The process provides embodiments of the method, wherein the sole comprises metal, the crown comprises a thermoplastic, composite, or polymer, and wherein joining the crown with the sole includes the application of adhesive.

The process provides embodiments of the method, wherein the openwork structure is determined according to a systematic application of pre-determined rules.

The process provides embodiments of the method, wherein making the support member comprises additive manufacturing of a metal.

The process provides embodiments of the method, wherein the recited steps specifically include fabricating the sole, then attaching the support member to an inside surface of the sole by welding; and then joining the crown with the sole to form the enclosed hollow body.

The process provides embodiments of the method, wherein the openwork structure is determined according to a systematic application of pre-determined rules that generates a Voronoi pattern.

The process provides embodiments of the method, wherein the golf club head comprises an adjustment mechanism for adjusting a feature of the club head. The process provides embodiments of the method, wherein the adjustment mechanism includes one or more attachment points for removable features. The process provides embodiments of the method, wherein the golf club head further comprises at least one removable weight removably attached to at least one of the one or more attachment points such that the adjustment-mechanism allows for adjustment of a mass or mass distribution of the club head.

Other embodiments are within the scope of the invention including, for example, support members in which an overall shape generally extends transversely, or heel-to-toe, within a club head.

Figure 10:
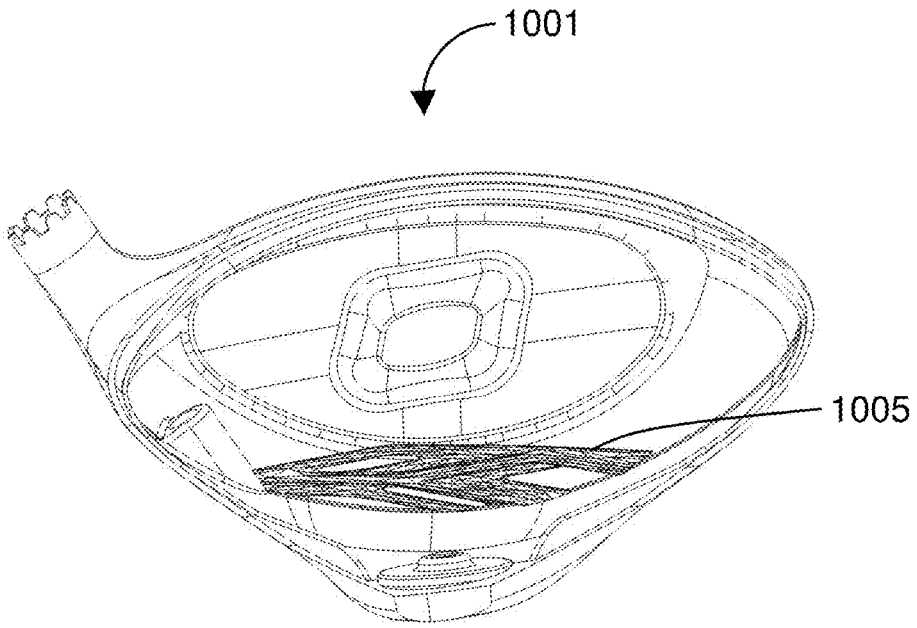
FIG. 10 is a back cut-away view of a club head with a transverse rib.

FIG. 10 is a back cut-away view of a club head 1001 with a transverse rib 1005. The transverse rib 1005 is predominantly a network of interconnecting struts (e.g., each of about a mm in diameter). The struts interconnect to a define a number of oblong diamondoid openings. The transverse rib 1005 may structurally reinforce the club head 1001, preventing materials fatigue or breakage, and the lightweight nature of the openwork allows for the inclusion of additional features.

Figure 11:
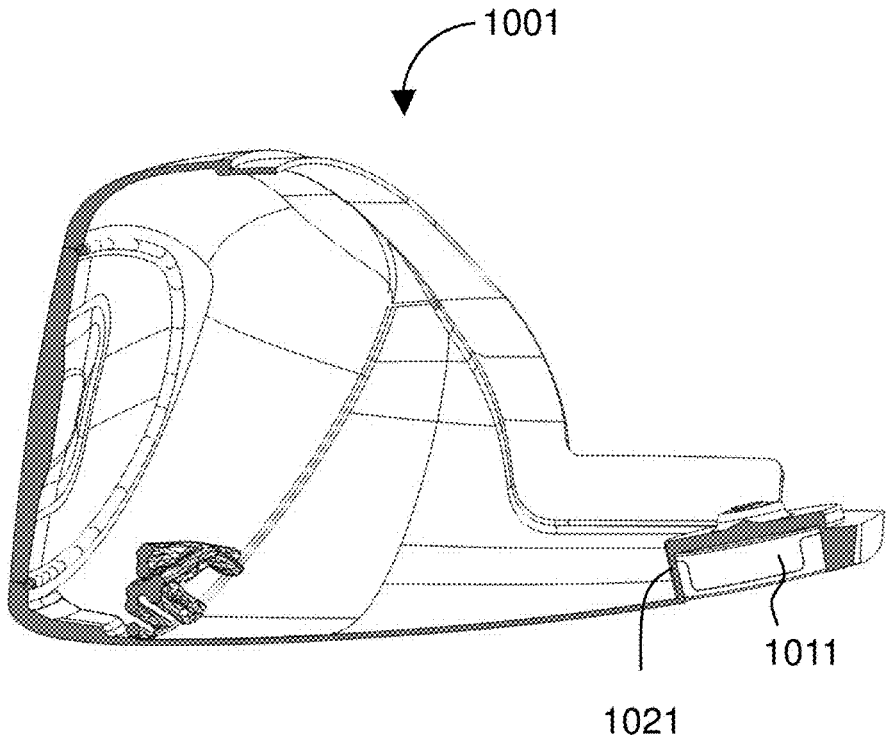
FIG. 11 is a side cut-away view of the club head with the transverse rib.

FIG. 11 is a side cut-away view of the club head with the transverse rib. The side cutaway view shows that the club head 1001 includes an adjustment mechanism 1031. The adjustment mechanism 1031 includes one or more attachment points 1021 for removable features. Specifically, the adjustment mechanism 1001 includes at least one removable weight 1011 removably attached to at least one of the one or more attachment points 1021 such that the adjustment-mechanism 1001 allows for adjustment of a mass or mass distribution of the club head.

An important benefit of the invention is the ability to attenuate sound in a golf club head by the inclusion of a support member with an openwork structure.

Figure 12:
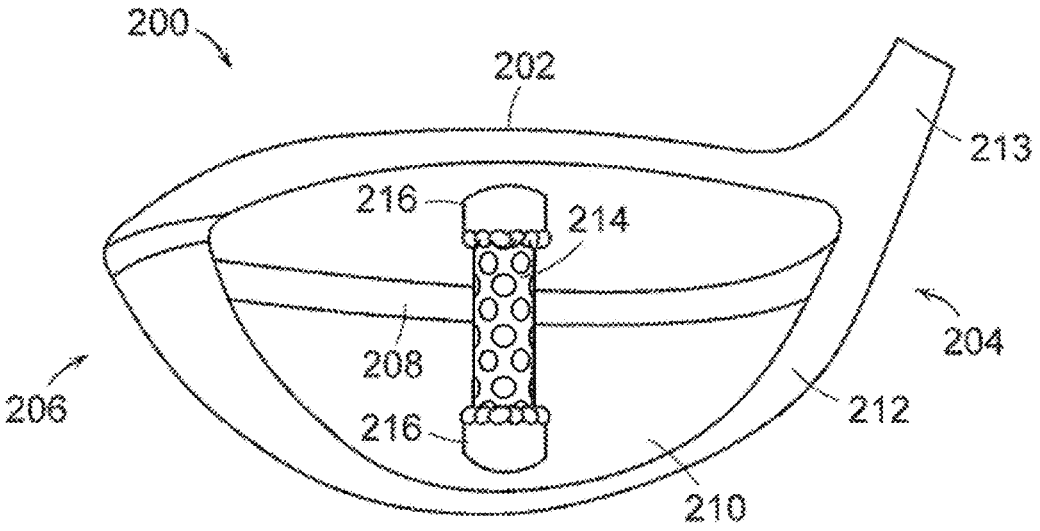
FIG. 12 shows a golf club head with a sound attenuating openwork support member.

FIG. 12 shows a golf club head 200 with a sound attenuating openwork support member 214. The golf club head 200 includes a ball-striking face 212 having a crown 202 and a sole 210 extending back from the ball-striking face 212, meeting at an aft portion 208, and cooperating to define an enclosed hollow body. A hosel 213 extends upwards from a heel side 204 of the hollow body (opposed to a toe side 206) when the club head is at address. The club head 200 includes a support member 214 comprising an openwork structure 218 disposed within the hollow body. By virtue of an openwork structure, the sound-attenuating support member does not add significant mass to a club head, allowing the club head to have an optimal mass distribution and an optimal sound. For such embodiments, a support member may be disposed at any suitable location within the club head.

Figure 13:
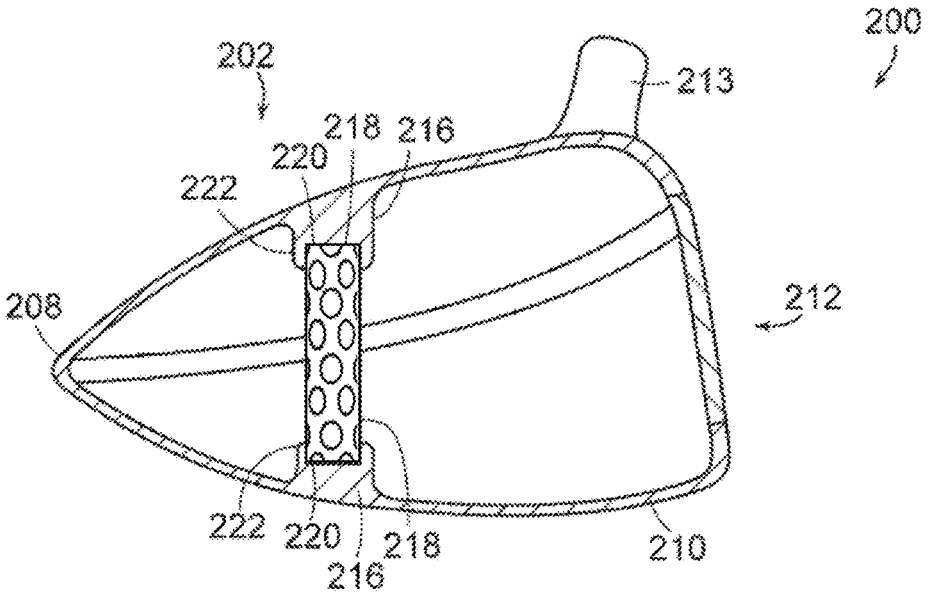
FIG. 13 is a cutaway view of the golf club head with a sound attenuating member.

FIG. 13 is a cutaway view of the golf club head 200 with a sound attenuating openwork support member 214. In the depicted embodiment, the support member 214 extends from the crown 202 to the sole 210. Additionally or alternatively, the support member may be disposed in any suitable orientation within the club head 200. Methods such as finite element analysis may be used to determine a location for a support member that modulates such a distracting or unpleasant sound into a striking sound that is less invasive and detrimental to play. Preferably such method are used to identify attachment point 216 at which respective ends 220 of the support member 214 are attached to inside surfaces of the club head 200.

In preferred embodiments, the support member 214 is manufactured by an additive or subtractive manufacturing process, such as by 3D printing. For example, the support member 214 may be 3D printed from a set of computer instructions embodying the shape.

A 3D printer can form the support member 214 with its openwork structural element 218. The support member 214 may be fastened to the crown, sole, or other components before those are joined together into a finished club head. For example, where the openwork structure is 3D printed from a metal such as titanium, by a process such as direct laser metal sintering, the structural element may be welded so that it is fastened in place by one or more welds 222 to an inside surface of the club head 200.

Preferably, the golf club head 200 has a hollow body defined by the crown 202, a heel portion 204, the toe portion 206, the aft portion 208, the sole 210, ball-striking face 212 and a hosel 213. The club head 200 may include any suitable number of the support members 214 such as one, two, three, four, or more. In the depicted embodiment, a single support member 214 extends between the attachment points 216 included on crown portion 202 and sole portion 210 and alters the vibration behavior of club head 200. In the depicted embodiment, the placement of support member 214 corresponds to a desired configuration for a club head having vibration characteristics. In particular, support member 214 may located so that it contacts the crown 202 adjacent a location of maximum displacement of a low frequency vibration mode.

It may be convenient to fashion the crown 202, sole 210, or both such that the attachment points 216 appear as bosses, embossed spots, or other features to guide attachment of the support member 214. However, this is not required and in some embodiments, the attachment points 216 are simply the locations at which the support member is attached (e.g., by welding) to an inside surface of the club head 200.

The support member 214 includes an openwork structure 218 and is characterized by holes, piercings, or gaps through a solid material such as metal, plastic, or both. Preferably, the support member 214 is made by 3D printing and is made of a metal.

The club head 200 may be made of any suitable material or materials including materials such as metals, plastics, metal alloys, composite materials, others, or combinations thereof. For example, the crown 116 may include metal, composite, plastic, thermoplastic, or carbon fiber. In certain embodiments, the sole 210 will include a metal (which may be referred to as a first metal, not to imply an order but to distinguish from other metals used in the club head 200, whether those metals are the same or different). For example, the sole 210 as well as any of the heel portion 204, the toe portion 206, and the aft portion 208 may be made of a first metal or metal alloy such as pure or alloyed steel, titanium, aluminum, others, or combinations thereof. In certain embodiments, the sole 210, the heel portion 204, the toe portion 206, and the aft portion 208 or provided as one titanium casting. The crown 202 may be a lightweight material such as a composite, carbon fiber, or pre-peg that is bonded to the titanium casting by, for example, an adhesive around a perimeter of the crown.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

The invention may be embodied in other specific forms without departing from the spirit or essential characteristics thereof. The foregoing embodiments are therefore to be considered in all respects illustrative rather than limiting on the invention described herein. Scope of the invention is thus indicated by the appended claims rather than by the foregoing description, and all changes which come within the meaning and range of equivalency of the claims are therefore intended to be embraced therein.

What is claimed is:

1. A golf club head comprising:

a ball-striking face;

a crown and a sole extending back from the ball-striking face and cooperating to define an enclosed hollow body;

a hosel extending upwards from a heel side of the hollow body when the club head is at address; and a first separately-constructed 3D printed support member comprising an openwork structure defining a Voronoi pattern disposed within the hollow body, wherein the first 3D printed support member defines an extended ridge with at least a first side and a second side and the openwork structure includes a plurality of apertures through the first side and the second side, wherein the first 3D printed support member is fastened at least partially to an interior surface of the sole and is positioned at, and configured to reinforce, a location of the club head identified, via finite element analysis, to exhibit strain in response to stress associated with impact between the ball-striking face and a golf ball;

a second 3D printed support member comprising an openwork structure defining a Voronoi pattern disposed within the hollow body, wherein the second 3D printed support member defines a buttress extending between an inside surface of the hosel and an inside surface of the sole; and an adjustment mechanism comprising one or more attachment points for removable features for adjusting a feature of the club head.

2. The club head of claim 1, wherein the first 3D printed support member comprises a metal.

3. The club head of claim 1, wherein the first 3D printed support member is welded to an inside surface of the hollow body.

4. The golf club head of claim 1, wherein the club head is a driver-style club head, wherein the crown comprises at least one material selected from the group consisting of metal, composite, plastic, thermoplastic, and carbon fiber, wherein the sole comprises a first metal and wherein the openwork structure comprises a 3D printed second metal.

5. The golf club head of claim 4, further comprising at least one removable weight removably attached to at least one of the one or more attachment points such that the adjustment-mechanism allows for adjustment of a mass or mass distribution of the club head.

* * * * *